US006167737B1

(12) United States Patent
Lyons et al.

(10) Patent No.: US 6,167,737 B1
(45) Date of Patent: Jan. 2, 2001

(54) VANE FORMING APPARATUS

(75) Inventors: John Lyons, Levittown; David Moses, Baldwin, both of NY (US)

(73) Assignee: Duro Dyne Corporation, Farmingdale, NY (US)

( * ) Notice: Under 35 U.S.C. 154(b), the term of this patent shall be extended for 0 days.

(21) Appl. No.: 09/551,235

(22) Filed: Apr. 17, 2000

(51) Int. Cl.[7] ..... B21B 39/02; B21D 5/14; B21D 9/10

(52) U.S. Cl. ..... 72/133; 72/169; 72/166

(58) Field of Search ..... 72/133, 166, 169, 72/170, 172, 177

(56) References Cited

U.S. PATENT DOCUMENTS

| | | | | |
|---|---|---|---|---|
| 1,936,454 | * | 11/1933 | Klocke | 72/166 |
| 2,245,407 | * | 6/1941 | Lignian | 72/166 |
| 2,353,925 | * | 7/1944 | Pattison | 72/133 |
| 2,756,803 | * | 7/1956 | Faeber | 72/166 |
| 2,990,001 | * | 1/1961 | Hansen | 72/166 |
| 3,304,757 | * | 2/1967 | Achler et al. | 72/166 |
| 3,937,052 | * | 2/1976 | Hoexter et al. | 72/166 |
| 4,057,990 | * | 11/1977 | Kelsey et al. | 72/166 |
| 4,428,215 | * | 1/1984 | Hume | 72/133 |
| 4,706,488 | * | 11/1987 | Williamson | 72/370 |
| 5,592,844 | * | 1/1997 | Baumgartner | 72/133 |

* cited by examiner

*Primary Examiner*—Rodney A. Butler
(74) *Attorney, Agent, or Firm*—Barry G. Magidoff; Paul J. Sutton

(57) ABSTRACT

The present invention is directed to a forming device adapted to impart a precise arcuate curvature to a sheet metal blank. The device includes a forming drum and a compression roller in proximate space relation to the surface of the drum. A characterizing feature of the device resides in a resilient deformable metal sheet having a lead surface fixed to the drum, the metal blank to be formed being captured between the drum surface and the flexible metallic sheet. Both the blank and the sheet are caused by the compression roller to conform to the curvature of the surface of the drum.

4 Claims, 3 Drawing Sheets

VANE FORMING APPARATUS

BACKGROUND AND FIELD OF THE INVENTION

The present invention is directed to a vane forming apparatus and more particularly, to a device for fabricating arcuate air turning vanes of the type utilized in duct systems for minimizing turbulence as air is conducted about right angle bends inducting.

Still more particularly, the present invention is directed to an apparatus for forming rectangular sheet metal blanks to the precise arcuate curvature which is effective to minimize frictional turbulence losses in air ducting.

PRIOR ART

It is well known in the air conditioning—heating art to provide, in duct branches, particularly at sharp corners or bends of a duct assembly, a series of vanes or blades of a curvature to guide air efficiently around corners or bends. Air turning assemblies are typically comprised of a spaced parallel pair of rails or plates spanned by a series of spaced blades, the blades being arcuate in section. A representative air guide device including improved means for holding the blades to the rails is disclosed in U.S. Pat. No. 2,959,195 assigned to the assignee of the instant application.

It has been determined that for optimal efficiency the radius of curvature of the air guiding vanes should be as close as possible to 4.5 inches.

Heretofore, blades having the desired curvature have been factory formed e.g., using metal bending brakes which fabricate elongate lengths which are subsequently cut to size in the field. Metal bending brakes are disadvantageous in that they are heavy and thus not conducive to on-the-job usage and often result in the fabrication of vanes which differ unpredictably and significantly from the ideal radius of curvature.

SUMMARY OF THE INVENTION

The present invention may be summarized as directed to a vane fabricating apparatus which is safe to use, light enough to be employed in the field, and which results in the formation of blades which consistently achieve the precise desired arcuate configuration which most efficiently functions to guide air with minimal turbulence losses.

More particularly, the apparatus of the present invention is capable of transforming a rectangular blank of galvanized sheet metal e.g., 20 or 22 gauge into a perfectly formed curved air guide vane.

The apparatus comprises a forming drum to which is fixed a resilient flexible metallic blade, a lead edge of the blade being affixed to the surface of the drum in parallel relation of the axis of the drum. A forming roll whose axis is likewise disposed parallel to the drum axis is located in proximate spaced relation to the surface of the drum. A sheet metal increment to be formed is inserted into the nip between the lead edge of the blade and the drum, following which the drum is rotated causing the blade and the galvanized sheet metal to be conformed to the surface of the drum. For reasons which are not entirely clear, it has been discovered that by capturing the metal blank to be formed between the resilient flexible blade and the surface of the forming drum, that the blade is bent in a repeatable, predictable and precise manner as contrasted with the mere use of rollers acting directly upon the metal to be bent and forcing the same against the outer surface of the drum. Preferably, trailing components of the blade are encased within a tray or chamber such that exposure of the sliding blank to the operator is positively prevented.

DETAILED DESCRIPTION OF DRAWINGS

Figure 1:
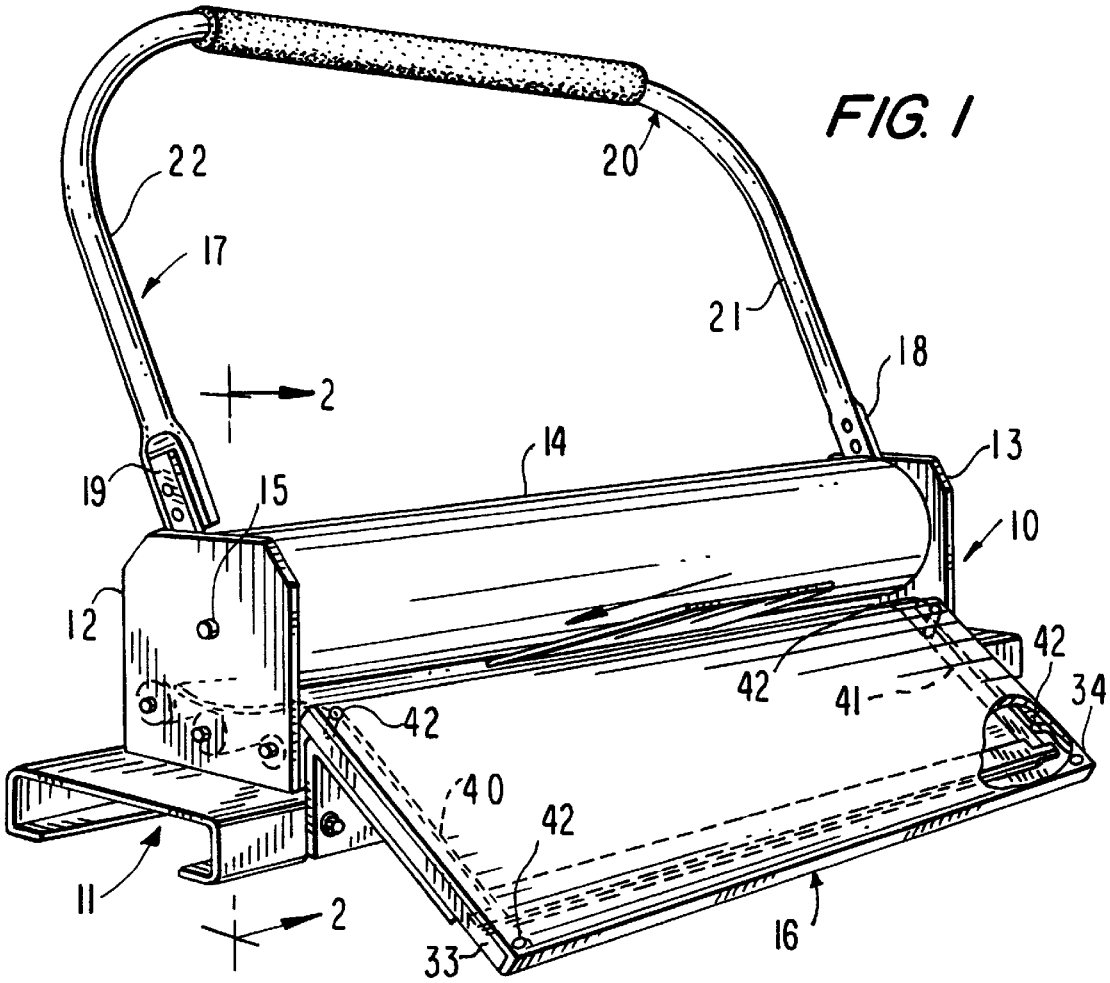
FIG. 1 is a front perspective view of the forming device of the invention.
Figure 4:
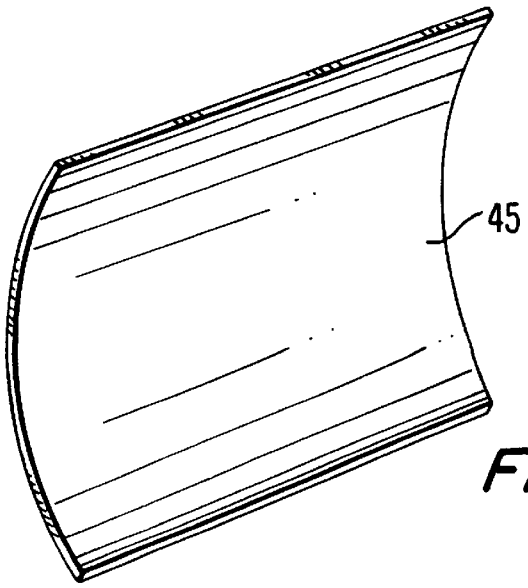
FIG. 4 is a perspective view of a formed air turning vane.

There is shown in FIG. 1 a perspective view of the vane forming apparatus 10, it being understood that frame 11 is typically mounted to support legs (not shown). The apparatus includes end plates 12, 13 between which plates is mounted the vane-forming roller 14. The roller 14 is rotatably supported on central shaft 15 the opposed ends of which are journaled in the respective plates 12, 13. The apparatus includes an in-feed tray assembly 16 to be described in detail hereinafter. An operating handle assembly 17 includes a spaced pair of drive lever arms 18, 19 coupled to the shaft 15. A yoke member 20 includes depending bars 21, 22 fixed to the drive levers 18, 19 respectively.

Figure 2:
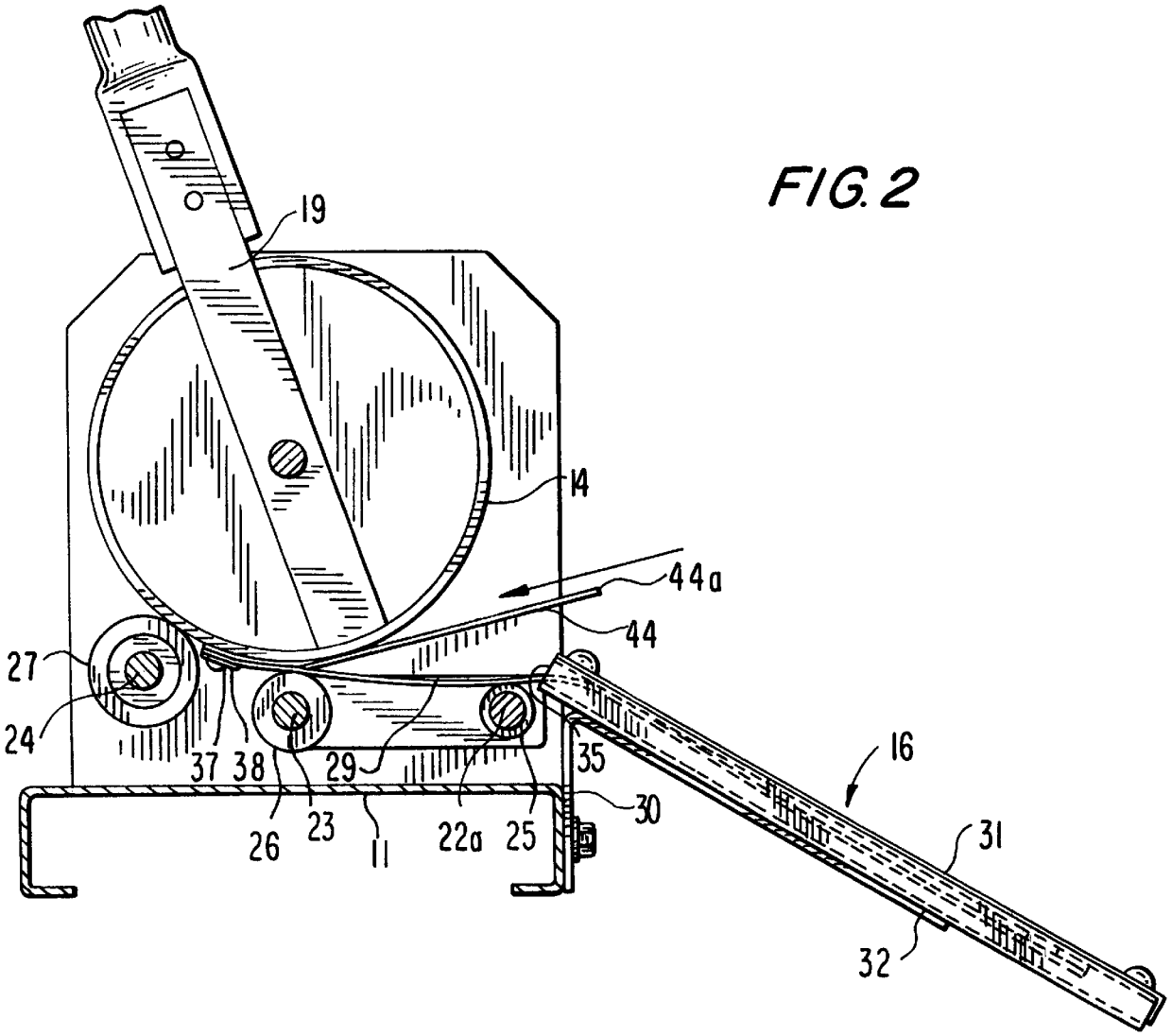
FIG. 2 is a vertical section taken on the lines 2—2 of FIG. 1 showing the device in the pre-operating condition.

Referring now to FIG. 2 there are rotatably supported between the two end plates 12, 13 feeder support roller shaft 22*a*, forming shaft roller 23 and backlash roller support shaft 24. A series of laterally spaced rollers 25 are mounted on support shaft 22*a*. Forming roll 26 is mounted on shaft 23 and is disposed in proximate spaced relation to the periphery of the forming drum 14. Preferably, adjustment means (not shown) are interposed between shaft 23 and frame 11 enabling precise spacing between roll 26 and drum 14.

Shaft 24 is provided with a series of laterally spaced apart backlash rollers 27 which may be formed of elastomeric material.

The apparatus includes an in feed tray assembly within which is contained spring steel forming blade 29.

The tray assembly 16 is fixed to frame 11 as by angled support brackets 30. The tray assembly 16 includes a feeder cover 31, feeder floor 32 and side channels 33, 34. The tray assembly includes an open mouth portion 35 through which the forming blade 29 passes.

The lead edge 37 of the blade 29 is clamped to the periphery of the forming drum 14 by transversely extending clamp bar 38. The side edges of the forming blade 29 are guided in channels in the side members 33, 34 of the tray assembly.

It has been determined that the formation of a blade whose radius of curvature is 4.5 inches is achieved, with the instant apparatus, by the use of a forming drum which is 5.5 inches in diameter.

Preferably, the device is provided with means for adjusting to process vanes of a variety of lengths. To this end, there provided laterally spaced centering bars 40, 41 shiftable transversely relative to the drum 14 and adjustably positioned through the use of adjustment bolts 42.

Figure 3:
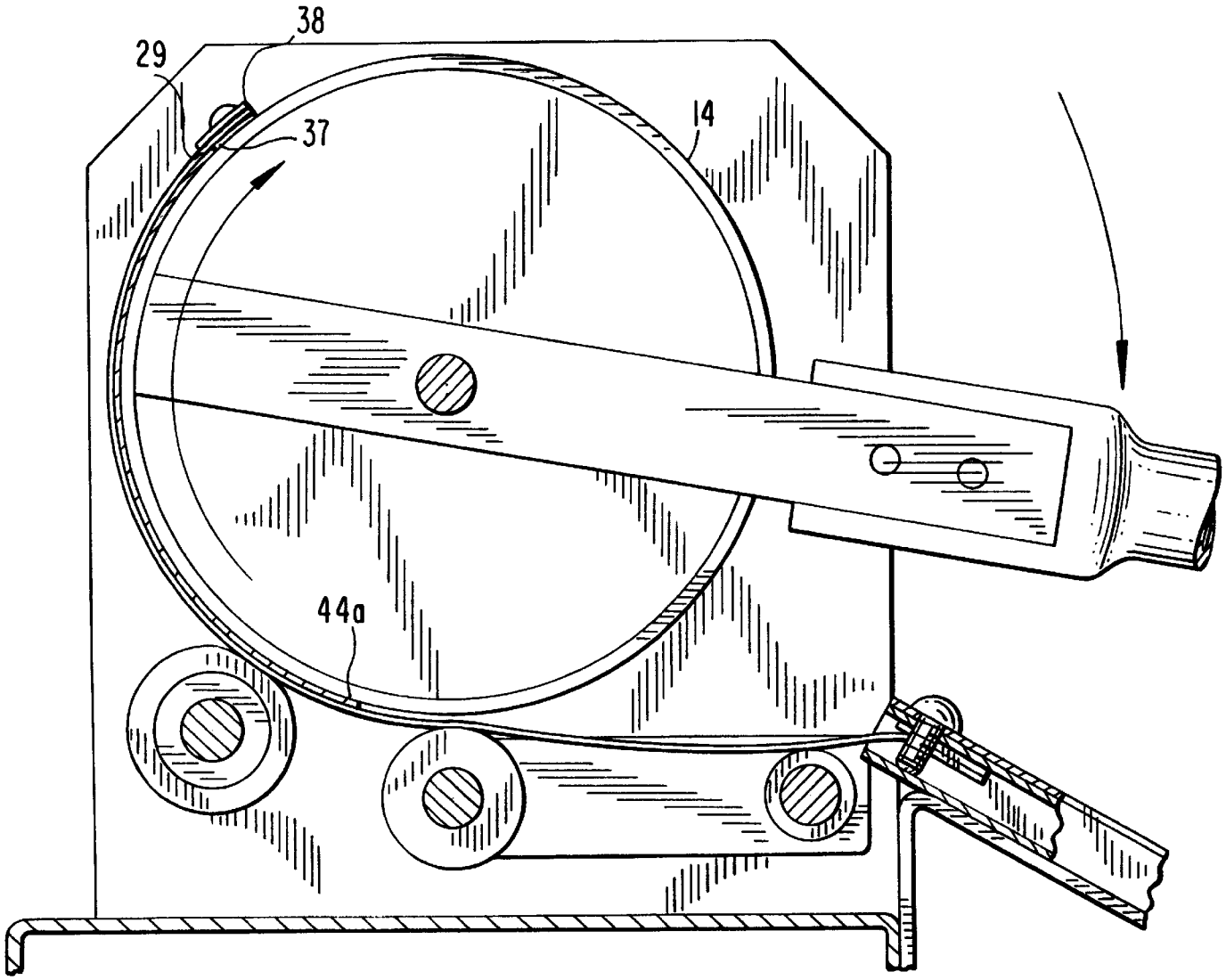
FIG. 3 is a magnified fragmentary vertical section showing the position of the parts after the same have been actuated through a vane forming cycle and prior to removal of the formed vane.

The operation of the device will be apparent from the preceding description. In use, a rectangular galvanized blank 44, typically 20 or 22 gauge, is inserted into the nip between blade 29 and drum 14. The metal sheet is advanced into abutting relation to the bar 38. In FIG. 2, the metal blank 44 is shown in partially inserted position. When the lead edge of the blank is fully inserted, handle 20 is pivoted in a clockwise direction from the position of FIG. 2 to the position of FIG. 3. In the course of such movement, the forming roll 26 will press against the forming blade 29 forcing the blade 29 and the metal sheet 44 to conform to the surface of drum 14. The forming blade will, in the course of operation of the handle, be withdrawn from the tray assembly 16. The blade 29 is supported by roller or rollers 25.

The series of transversely spaced back lash rollers 27 function to prevent the lead edge 44*a* of the metal blank from deflecting downwardly against the surface of forming roll 26 in the course of return movements (anti-clockwise) of the handle 20. Upon completion of the return anti-clockwise movement, the formed blade 45 expands somewhat in a predictable manner to assume the optimal 4.5-inch radius. For reasons which are unclear, a metal blank caused to conform to the surface of the drum 14 without the utilization of the spring steel sheet or blade 29 results in the formation of vanes which fail to exhibit, on a repeatable basis, the arcuate configuration which is desired. The blade 29, in addition, co-acting with the anti back lash rollers 27 assures that the formed blade will be shifted clear of the apparatus upon return movement of the handle 20 without jamming.

The handle assembly 20 is spring biased to its anti clockwise position and stops (not shown) are provided to limit the clockwise and anti clockwise positions of the handle.

By way of example and without limitation, the forming blade or sheet is fabricated of spring steel preferably 0.012 thickness.

As will be apparent from the preceding description, there is provided in accordance with the invention an apparatus which enables galvanized sheet metal e.g., 20 to 22 gauge, to be conformed to a precise (4.5 inch radius) curvature. The device is simple to operate, portable, and safe. As will be apparent to those skilled in the art and familiarized with the instant disclosure, variations in details of construction may be made without departing from the spirit of the invention. Accordingly, the invention is to be broadly construed within the scope of the appended claims.

What is claimed is:

1. An air guide vane forming device for converting a flat rectangular sheet metal blank to a precise arcuate configuration, comprising a forming drum having an arcuate surface, a resilient metallic forming blade having a lead edge fixed to a surface of said drum, said edge being aligned with the axis of said drum, stop means interposed between said lead edge and said drum for aligning the lead edge of a metal blank inserted between said blade and drum with said axis of said drum, compression roller means disposed in proximate spaced relation to said surface of said drum, said compression roller means having its longitudinal axis aligned with the axis of said drum, said blade being interposed between said roller and drum, and means for rotating said drum about an axis parallel to said arcuate surface whereby said blade is caused to conform to the curvature of said surface and a said blank to be formed interposed between said blade and said arcuate surface is bent to the curvature of said surface.

2. A forming device in accordance with claim 1 and including an in-feed tray comprising a base, a laterally spaced parallel pair of channels disposed at the sides of said base and directed toward said forming drum, said forming blade being disposed in covering relation of said base, each said side edge portion being slideably received in a respectively said channel of said in-feed tray.

3. A forming device in accordance with claim 1 and including backlash roller means aligned with the axis of said drum and disposed in proximate space relation to the surface of said drum, said backlash roller means being located downstream of said compression roll, said backlash roller means adapted to maintain the trailing edge of a formed blank in an engagement with said drum until said trailing edge passes beyond said compression roll.

4. A forming device in accordance with claim 2 and including support means interposed between said in-feed tray and said forming drum engaging the undersurface of said forming blade for resisting downward deflection of said blade.

* * * * *